United States Patent [19]

Rieth

[11] 4,096,688

[45] Jun. 27, 1978

[54] EXPANSIBLE LINKAGE FOR WRIST WATCH BRACELETS, IDENTIFICATION BRACELETS AND THE LIKE

[75] Inventor: Kurt Albert Rieth, Warwick, R.I.

[73] Assignee: Textron Inc., Providence, R.I.

[21] Appl. No.: 787,975

[22] Filed: Apr. 15, 1977

[51] Int. Cl.[2] ..... F16G 13/24; A44C 5/18

[52] U.S. Cl. ..... 59/79 R; 24/206 R; 224/4 E; 24/265 WS

[58] Field of Search ..... 24/206 R, 265 B, 265 WS, 24/70 J, 70 ST, 71 J, 73 WW, 70 R; 224/4 E; 59/79 R

[56] References Cited

U.S. PATENT DOCUMENTS

| | | | |
|---|---|---|---|
| 1,742,457 | 6/1930 | Wittman | 24/265 B |
| 1,744,685 | 1/1930 | Nittel | 24/265 B |
| 1,764,440 | 6/1930 | Gammell | 24/206 R |
| 2,826,900 | 3/1958 | Augenstein | 24/265 B |
| 2,850,783 | 9/1958 | Megar | 24/265 WS |
| 3,965,670 | 6/1976 | Ihringer | 24/265 B |

FOREIGN PATENT DOCUMENTS

| | | | |
|---|---|---|---|
| 173,666 | 7/1952 | Austria | 24/206 R |

*Primary Examiner*—Bernard A. Gelak
*Attorney, Agent, or Firm*—Robert L. Thompson

[57] ABSTRACT

This disclosure is directed to expansible linkages for expansible wrist watch bracelets, identification bracelets and similar articles which permit the retail jeweler to quickly and easily adjust the length of a bracelet to fit different size wrists of customers.

The bracelet includes two sections of expansible linkages of each of which has a row of top links, a row of bottom links, means interconnecting the links of each row with the links of the other row to provide longitudinal displacement of the links relative to each other from contracted to expanded positions and vice versa. A channel shaped outer member has a series of aligned perforations extending through its side walls. First spring pin means connected to one end of one of the expansible sections has the outer ends of its trunions extending into a first selected pair of the aligned perforations. Second spring pin means connected to one end of the other expansible section has the outer ends of its trunions extending into a second selected pair of the aligned perforations. A one-piece inner member having a bottom wall and a pair of spaced upwardly extending side members is detachably connected between the side walls of the outer member thereby to enclose the ends of the expansible linkage sections and the spring pin means in such a manner that the outer ends of the trunions of the spring pin means may be depressed from the exteriors of the side walls of the channel shaped outer member to adjust the length of the bracelet.

10 Claims, 24 Drawing Figures

EXPANSIBLE LINKAGE FOR WRIST WATCH BRACELETS, IDENTIFICATION BRACELETS AND THE LIKE

BACKGROUND OF THE INVENTION

There has been a long-felt need for an expansible linkage for use as a wrist watch bracelet, identification bracelet and and the like which is economical to manufacture, assemble and repair, which is durable and which permits the length of the bracelet to be quickly and easily adjusted to fit different size wrists of customers thereby reducing the inventory of bracelets which it is necessary for the retailer to carry and also the time required by the jeweler to adjust the length of a bracelet to fit the individual customer's wrist.

While Nittel U.S. Pat. No. 1,744,685 dated Jan. 21, 1930 discloses a hollow casing 1 having integral top, side and bottom walls with a series of aligned perforations extending through the side walls for receiving the ends of the trunions of the spring pin means to adjust the length of a two strip non-expansible bracelet 2—2, it does not disclose a separate one-piece inner member having spaced upwardly extending side members and means for detachably connecting the side members to the side walls of a channel shaped outer member. Consequently, it is difficult to assemble the Nittel bracelet sections 2 with his hollow casing 1 and to repair the assembly if the spring pin means become jammed or otherwise inoperative because they are inaccessible from the exterior of the casing. Furthermore, if the casing was made of gold filled or gold plated materials, it would be very expensive because the gold would be on its entire outer surface. In addition, it would be necessary to drill the holes 3 thus forming burrs on the inside of the side walls of the casing and it would be very difficult to get at and remove them.

While Brunet French Pat. No. 1,050,589, published Jan. 8, 1954 discloses in FIGS. 7 through 11 two sections the ends of which are connected together by a channel shaped outer member $e^2$ having its side walls provided with a series of aligned holes $f^1$, the studs $r$ which pass through the holes are not spring pin means, instead they are rigid and have enlarged heads as shown in FIG. 9. Consequently for the retail dealer to adjust the length of the bracelet to the wrist of a customer, he must perform the time consuming task of inserting the studs $r$ in the selected aligned holes $f^1$, securing them in the holes by forming at least one head on the end of each stud. Furthermore, the sockets $p$ slide upon the studs $r$ every time the watch and watch bracelet are slipped over the hand of the wearer to his wrist and removed from it, which would be at least twice each day, and the resultant friction would cause the sockets $p$ and/or the shanks of the studs $r$ to wear out quite rapidly thereby necessitating repairs by the manufacturer of the bracelet. In addition, this embodiment does not include a one-piece inner member comprising a bottom wall and a pair of upwardly extending side members nor means for detachably securing the side members to the side walls of the outer member $e^2$.

Brunet's first embodiment shown in FIGS. 1 through 6 provides for adjustment of the length of the watch bracelet by a series of interiorly threaded holes $f$ in the bottom wall of the inner member $e^1$ and screws $l$ which pass downwardly through tubular members at the junctions of the half legs $i^1$ and $j^1$ with the threads on their ends meshing with the threads of the holes $f$. Consequently for the retail dealer to adjust the length of the watch bracelet, it would be necessary for him to remove the ornamental cowl piece $n$, screw at least one screw into at least one hole and then the cowl piece.

Fischer German Pat. No. 1,234,440 dated Feb. 16, 1967 discloses two non-expansible watch bracelet sections 10 and 11 the ends of which are connected together by a device which includes a channel shaped inner member 1 comprising a bottom wall and a pair of upwardly extending side members which are provided with a series of aligned holes 3. The upper ends of the side walls are provided with outwardly projecting guide rails 17. The ornamental cover 2 has its longitudinal sides provided with channels which slidably receive the rails 17 so the cover can be moved from the closed position shown in full lines to the open position shown in dot dash lines in FIG. 4.

One end of each watch bracelet section is provided with a "hook end" 12. The outer ends of the trunions of the spring pin means 4 pass into a selected pair of the holes 3 so the position of the spring pin can be adjusted longitudinally of the side members of the inner member. The eccentric hook 5 includes a segment of a tube 6 which passes about the spring pin. The tube has a detent hook 7 and a flat bar 8 with a notched edge 9. The bracelet hook end 12 is placed on the eccentric hook 5 and locked about it by the detent hook 7 and thus the end of the bracelet section is detachably secured to the eccentric hook 5 and the enclosed spring pin 4.

Thus this Fischer device does not include a channel shaped outer member having a series of aligned perforations extending through its side walls and because Fischer's holes 3 extend through the side members of his inner member 1, it would be necessary to make his inner member of gold-filled or gold-plated material to provide an attractive watch bracelet when the cover 2 and links of the watch bracelet are made of gold-filled or gold-plated materials thus substantially increasing the cost of the entire bracelet.

Because the Fischer device includes a sliding cover and the complicated eccentric hooks 5, detent hooks 7 and flat bar 8, it would be very expensive to manufacture and assemble two sections of a watch bracelet with these elements.

Furthermore, it would be necessary to open at least one end of the cover and detach the hook end 12 to adjust the length of the bracelet so it would be a time consuming task for the retail jeweler.

In addition, Fischer's cover is much wider than the bracelet sections and creates an unattractive appearance which would not be acceptable by today's standards.

So far as I know the Nittel, Brunet and Fischer bracelets have not been manufactured or sold in the United States nor met with any commercial acceptance in the United States.

While non-expansible watch bracelets made of two bracelet sections connected together by a foldover buckle assembly in which one section has its end connected by a spring pin means to a channel shaped outer member having a series of aligned perforations extending through its side walls for use in adjusting the length of the bracelet has been marketed extensively in the United States for many years, the buckle is bulky, it must be unclasped to slip the watch and bracelet over the hand of the user to encircle his wrist and to remove them from his wrist and the assembly includes only one spring pin means for adjusting the length of the bracelet.

The above described prior art is the closest prior art of which I am aware to an expansible linkage embodying my invention as described and claimed in this application.

BRIEF SUMMARY OF THE INVENTION

One object of this invention is to provide an expansible linkage for use as a wrist watch bracelet, identification bracelet and the like which permits the length of the bracelet to be quickly and easily adjusted by a retail dealer to fit different size wrists of customers.

Another object is to provide such an expansible linkage which is economical to manufacture and assemble.

A further object is to provide such an expansible linkage which is durable in use.

A still further object is to provide such an expansible linkage which is easy to disassemble for repair.

Yet a further object is to provide such an expansible linkage which is attractive in appearance.

Another object is to provide such an expansible linkage the visible parts of which can be made economically of gold-filled, gold-plated and other precious metal containing materials.

Further objects and advantages of this invention will be apparent to persons skilled in the art from the following description taken in conjunction with the accompanying drawings.

In general an expansible linkage embodying this invention includes at least two expansible linkage sections each of which comprises a row of top links and a row of bottom links, means interconnecting the links of one row with the links of the other row to provide displacement of the links relative to each other when the linkage is stretched longitudinally from a contracted to an expanded position and resilient means associated with the links for resisting the displacement of the links and for returning them from expanded to contracted positions upon release of the longitudinal stretching force. It also includes a channel shaped outer member which comprises a top wall, a pair of spaced side walls and a series of aligned perforations extending through the side walls. In addition, it includes first spring pin means connected to one end of one of the expansible sections having the outer ends of its trunions extending into a first selected pair of the aligned perforations. It also includes second spring pin means connected to one end of the other expansible linkage section having the outer ends of its trunions extending into a second pair of aligned perforations which are spaced longitudinally from the first pair. A one-piece inner member is provided which includes a bottom wall and a pair of spaced upwardly extending side members. Finally means for detachably connecting these upwardly extending side members to the side walls of the channel shaped outer member are provided.

The inner member closes the opening between the lower ends of the side walls of the channel shaped outer member, the ends of the expansible linkage sections are positioned between the top wall of the inner member and the trunions of the first and second spring pin means can be depressed from the exterior of the channel shaped outer member to adjust the length of the linkage without disassembly of the combined outer and inner members.

In a preferred embodiment of the expansible linkage, the upwardly extending side members include a pair of tab means having a pair of aligned perforations extending therethrough and third spring pin means is provided having its trunions extending into the aligned perforations of the tab means and a pair of aligned perforations of the side walls of the channel shaped outer member.

In one embodiment of the invention, the top links of the expansible linkage sections are longer than the bottom links, the side walls of the channel shaped outer member are spaced apart a greater distance than the length of the top links and the upwardly extending side members of the inner member are spaced apart a shorter distance than the side walls of the channel shaped outer member and a greater distance than the length of the bottom links.

In another embodiment, the inner member also includes flanges extending outwardly from the upper ends of the upwardly extending side members beneath the inner surfaces of the outer portions of the top links and the means for detachably connecting the spaced upwardly extending side members of the inner member includes a pair of tabs which extend upwardly from the outwardly extending flanges.

In yet another embodiment, the means for detachably connecting the upwardly extending side members of the inner member to the side walls of the channel shaped outer member includes third spring pin means which is located substantially at the centers of the upwardly extending side members and the outer ends of the trunions of this spring pin means extend into a pair of the aligned perforations which is substantially at the center of the series of aligned perforations of the side walls of the outer member.

In a still further embodiment, the pair of aligned perforations which receive the outer ends of the trunions of the third spring pin means are located out of alignment with the series of aligned perforations for receiving the outer ends of the trunions of the first and second spring pin means.

In still another embodiment, the upwardly extending side members of the inner member are positioned within the downwardly extending side walls of the outer member and thereby concealed from view so it is unnecessary to make the inner member from a precious metal.

It will be apparent to persons skilled in the art that this invention has solved the above described, long-felt need and satisfied the above described objects.

DETAILED DESCRITPION OF THE FIRST EMBODIMENT

Figure 1:
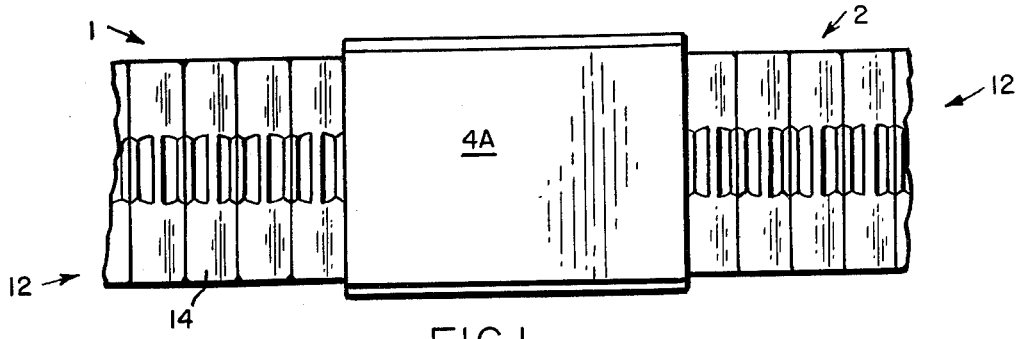
FIG. 1 is a top plan view of the first embodiment of an expansible linkage embodying the invention, the expansible linkage being shown in contracted position.
Figure 2:
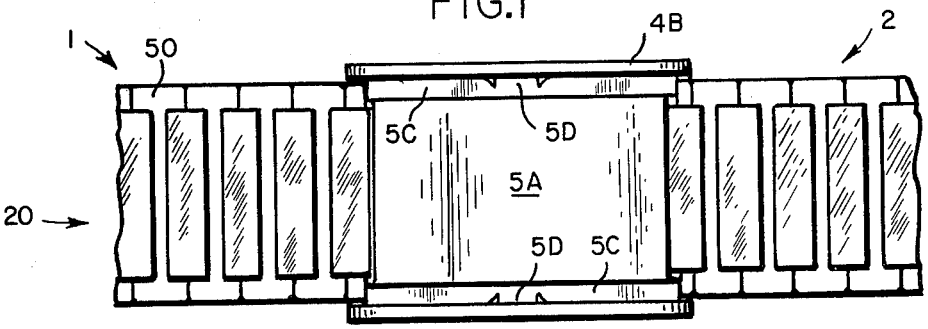
FIG. 2 is a bottom plan view of the linkage shown in FIG. 1.

An expansible linkage embodying this invention is useful in expansible watch bracelets, identification bracelets and the like to permit the length thereof to be easily adjusted to fit different size wrists thereby reducing the inventory of bracelets which it is necessary for the retailer to carry as well as reducing the time of the jeweler required to adjust the length of the bracelet.

In the first embodiment of the invention which is shown in FIGS. 1 thru 14, the expansible linkage comprises two expansible linkage sections indicated generally by the numerals 1 and 2 and a length adjusting device which comprises a channel shaped outer member 4, a one-piece inner member 5, a first spring pin means 6 and a second spring pin means 7.

The outer member 4 comprises a top wall 4A and a pair of spaced side walls 4B each of which is provided with a series of aligned perforations 4C extending therethrough.

The inner member 5 comprises a bottom wall 5A and a pair of spaced upwardly extending side members 5B.

The expansible linkage sections 1 and 2 are provided with generally tubular end members 1A and 2A which receive the first and second spring pin means 6 and 7 respectively. The outer ends of the trunions 6A and 7A of the first and second spring pin means are received in selected pairs of the aligned perforations 4C and the length of the bracelet can be adjusted by varying the pairs of aligned perforations into which the outer ends of the trunions of the spring pins are placed.

Figure 5:
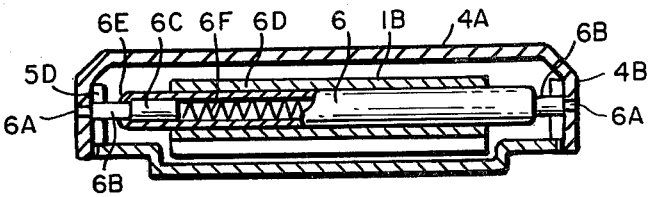
FIG. 5 is an enlarged section taken on the lines 5—5 of FIG. 3.

As shown in FIG. 5, the trunions of each first spring pin means 6 comprises a cylindrical outer end portion 6A, a cylindrical portion 6B of greater diameter and another cylindrical portion 6C of still greater diameter. Each spring pin means also comprises a generally tubular member 6D which has annular flanges 6E at each end. It also comprises a coiled compression spring 6F. The compression spring urges the trunions outwardly and the flanges 6E serve as stops for such outward movement. The second spring pin means 7 is of the same construction. Similar spring pin means have been used extensively to detachably secure the ends of watch bracelets between the lugs of wrist watches.

Figure 7:
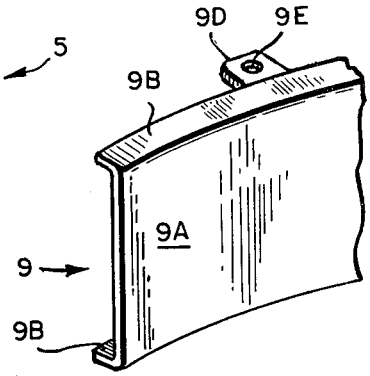
FIG. 7 is an isometric view of a one-piece inner member with parts broken away, the side walls of which are straight rather than flanged as shown in FIGS. 4 and 5.
Figure 6:
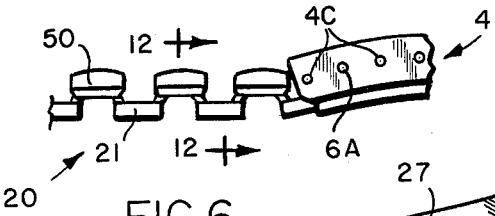
FIG. 6 is a side view of a portion of the linkage of FIG. 1 in an expanded position.
Figure 7A:
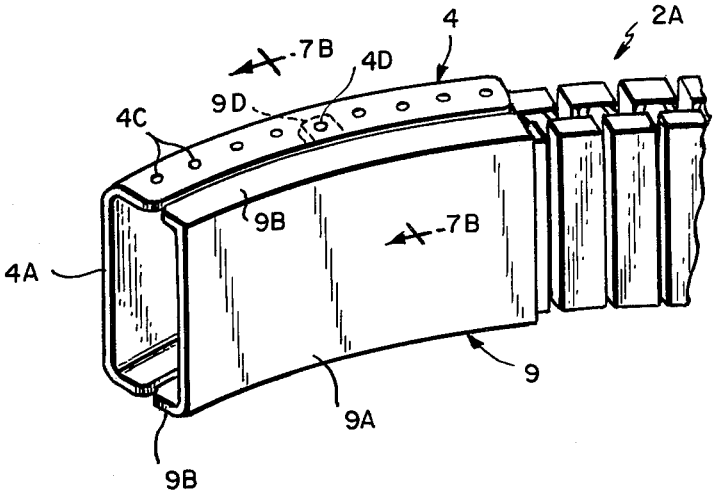
FIG. 7A is an isometric view looking at the bottom of an assembly which includes the inner member of FIG. 7 assembled with a channel shaped outer member and one end of an expansible linkage.
Figure 7B:
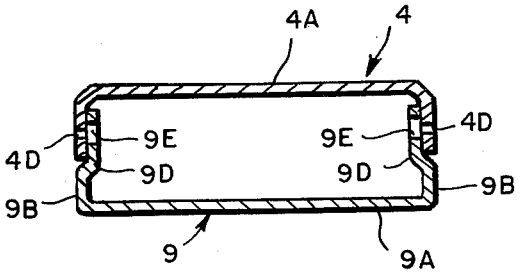
FIG. 7B is an enlarged section taken on the lines 7B—7B of FIG. 7A.

In the embodiment shown in FIGS. 1 to 14, except for the embodiment shown in FIGS. 7, 7A and 7B, the top shells of the linkage sections are longer than the bottom links and upwardly extending side members 5B of the inner member 5A are provided with flanges 5C. A pair of tab means 5D extend upwardly from the side walls and a pair of aligned perforations 5E extend through these tabs. The third spring pin means 8 is of the same construction as the first and second spring pin means 6 and 7.

The end of the cylindrical portion 6B extends through the perforations 5E of the tab means and the cylindrical portions 6A extend through centrally disposed perforations 4D of the side walls of the outer member. The outer ends of the cylindrical portions 6B are of greater diameters than the diameters of the perforations 4D so the ends of the portions 6B function as stops to limit the outward movements of the ends 6A of the trunions. Thus the outer and inner members are detachably secured together about the ends of the linkage sections 1 and 2. The inner ends of the linkage sections are expansible in the assembly because the links which are located between the outer and inner members may slide longitudinally thereof when the linkage is expanded.

The length of the linkage can be adjusted without removing the inner member 5 from the outer member 4. This is accomplished by depressing the outer ends of the trunions of either the spring pin 6 or the spring pin 7 by a pointed instrument and then sliding the end 1 or 2 of one of the linkage sections longitudinally of the outer and inner members until the outer ends of the trunions enter a different pair of aligned perforations 4C.

Since the ends of both expansible linkage sections 1 and 2 are provided with spring pin means, a greater selection of adjusted lengths of a bracelet is available.

By locating the third spring pin means 8 substantially at the center of the side members of the inner member, only one spring pin means is necessary to attach the inner member to the outer member, it is easy to attach the inner member to the outer member and the third spring pin means does not interfere with the length adjustments of either or both of the expansible linkage sections 1 and 2. Because the ends of the expansible sections do not overlie each other, a thin and attractive length adjustment section is provided.

The channel shaped outer member 4 may be made of gold-filled or gold-plated stock and the inner member 5 of stainless steel or other suitable non-precious metal without detracting from the appearance of the assembly because the upwardly extending side members 5B of the inner member are concealed from view by side walls 4B of the outer member.

Except for the lengths of the top shells, the expansible linkage sections 1 and 2 shown in FIGS. 1 through 14 of the drawings are of the type shown in U.S. Pat. Nos. 3,307,348 dated Mar. 7, 1967 to Vanover; 3,416,305 dated Dec. 17, 1968 to Rieth; 3,587,226 dated June 28, 1971 to Rieth; 3,994,126 dated Nov. 30, 1976 to Rieth; 2,689,450 dated Sept. 21, 1954 to Stiegele; 3,543,507 dated Dec. 1, 1970 to Vanover and Flaig; 3,705,490 dated Dec. 12, 1972 to Ripley; and 3,897,612 dated Aug. 5, 1975 to Bert.

Figure 14:
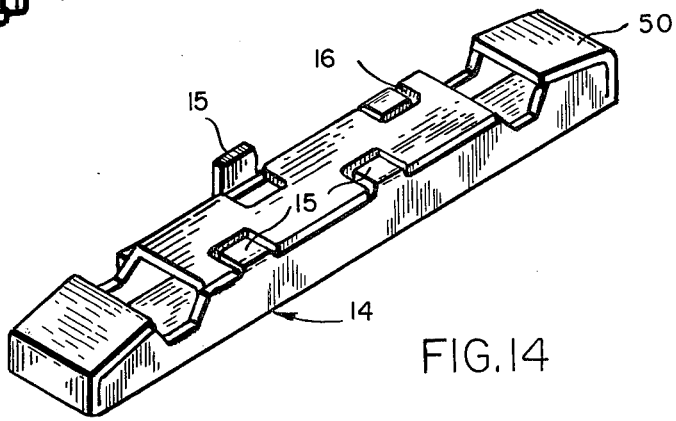
FIG. 14 is an isometric view looking at the bottom of a top link and assembled top shell with one tab of the top shell shown in a position before being bent inwardly and with the leaf spring and connecting members omitted.

Each linkage section 1 and 2 comprises two rows of overlapping staggered links, a top row 12 and a bottom row 20 (see FIGS. 3, 4, 6, 11 and 12) each link extending in a direction generally transverse to the length of the linkage when viewed from the top or bottom. The top link 13 (FIGS. 11, 12 and 14) is provided with an ornamental top shell 14 which is secured to the top link by four tabs 15 which are bent inwardly into notches 16 provided in the inner wall of the top link as shown in FIG. 14.

Figure 3:
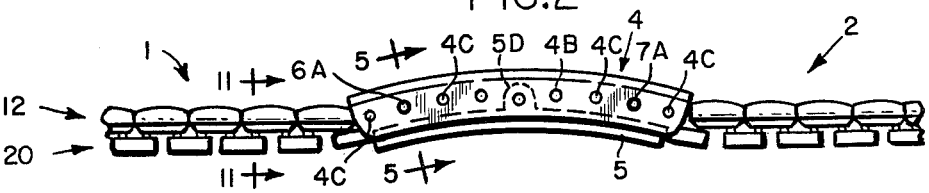
FIG. 3 is a side elevation of the central portion of the linkage of FIG. 1.
Figure 8:
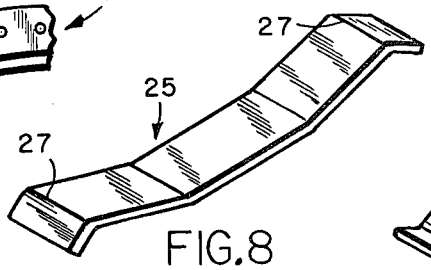
FIG. 8 is an isometric view of one of the leaf springs used in the top links of the expansible linkage sections shown in FIG. 1.
Figure 9:
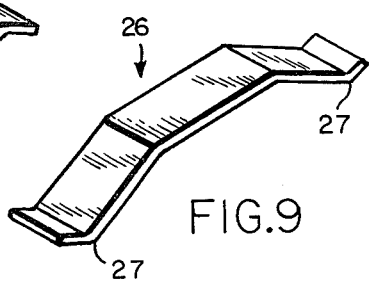
FIG. 9 is an isometric view of one of the leaf springs used in the bottom links of the expansible linkage sections shown in FIG. 1.
Figure 10:
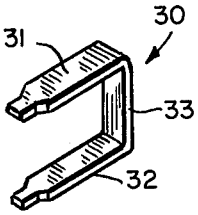
FIG. 10 is an isometric view of one of the connecting members of the expansible linkage sections shown in FIG. 1.

There is a leaf spring located in each top link and in each bottom link. The leaf spring 25 for the top link is shown in FIG. 8 and the leaf spring 26 for the bottom link is shown in FIG. 9. It is similar except that it is narrower since the bottom links are narrower than the top links as shown in FIGS. 3 and 6 to provide spaces between the sides of the bottom links when the linkage lies flat in contracted position.

Figure 11:
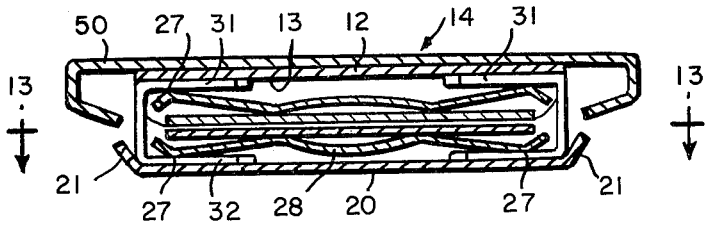
FIG. 11 is an enlarged section taken on the lines 11—11 of FIG. 3.
Figure 12:
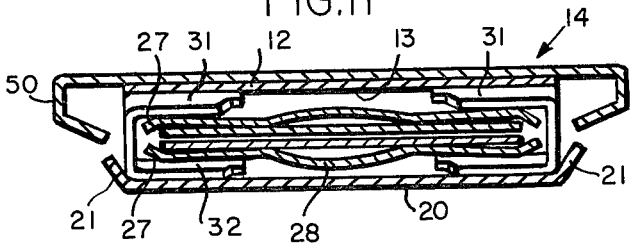
FIG. 12 is an enlarged section taken on the lines 12—12 of FIG. 6.
Figure 13:
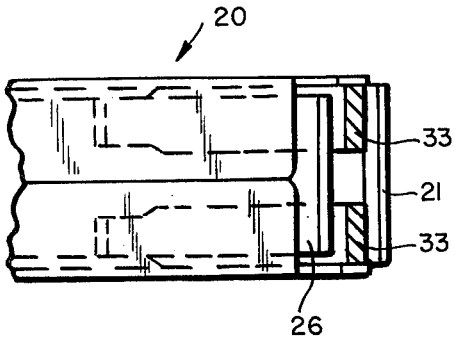
FIG. 13 is an enlarged horizontal section taken on the lines 13—13 of FIG. 11.

The links of the top row are connected to the links of the bottom row by U-shaped connecting members 30 (FIG. 10), the legs 31 and 32 of which are positioned between the bends 27 of the springs and the outer walls of the top and bottom links respectively as shown in FIGS. 11 and 12.

Tabs 21 are bent upwardly at the ends of the bottom links 20 to hold the U-shaped connecting members 30 in the links.

In assembled condition, the legs 31 and 32 of the connecting members extend within the links in a direction generally transverse to the length of the linkage. The legs 31 of two of the four connecting members in each top link are located within the top link near one side thereof and the other legs 32 of these connecting members are located within an adjacent link of the bottom row. The other two connecting members are located near the opposite side of the linkage and their legs are located within the links near the opposite sides in the same way. These connecting members are repeated to provide a linkage of the desired length.

To assemble the linkage, the leaf springs are inserted in the top and bottom links. This causes the ends of the springs to be deflected from their unloaded heights of FIGS. 8 and 9 to partially loaded heights. The legs of the connecting members are then inserted between the bends 27 of the springs and the outer walls of the links. This causes the ends of the springs to be further deflected to their working heights shown in FIG. 11 when the linkage is in its fully contracted position of FIGS. 1, 3 and 11. Then the tabs of the bottom links are bent upwardly to the positions shown in FIG. 11.

In the contracted position of FIG. 11, the central part 28 of each spring bears against an intermediate portion of the inner wall of the link and the bends 27 engage pairs of legs of the connecting members, thus resiliently urging the linkage to its fully contracted position shown in FIGS. 1, 3 and 11. When the linkage is expanded from the position shown in FIGS. 1, 3 and 11, the ends of the springs are further deflected from their working heights. This deflection of the springs is caused by the turning or rotating movements of the legs 31, 32 of the connecting members as shown in FIG. 12.

Upon release of the expanding or stretching force, the springs acting upon the legs of the connecting members return the linkage to its contracted position.

The end members 1A and 2A comprise generally tubular members 1B and 2B at the upper ends of the members 1C (not shown) and 2C which slidably receive the spring pin means 6 and 7 respectively. The members 2D (FIG. 4) are generally elliptical in cross section and they receive the lower legs 32 of the end connecting members 30 thereby securing the end members 1A and 2A to the expansible linkage sections 1 and 2 respectively.

The top shells 14 are longer than the top and bottom links 13 and 20 since the hollow end portions 50 project outwardly beyond the ends of the top and bottom links.

However, the well known prior art expansible linkages of the types shown in U.S. Pat. Nos. 3,994,126; 3,587,226; 3,543,507; 3,705,490; 3,416,305 and 3,897,612 in which the top shells are of substantially the same length as the top and bottom links may be used for the expansible linkage sections of this invention.

When such expansible linkages are used for the sections 1 and 2, the upwardly extending side members of the inner member do not include flanges 5C. Such a construction is shown in FIGS. 7, 7A and 7B where the inner member is indicated generally by the numeral 9, having a bottom wall 9A, a pair of side members 9B and a pair of tab means 9D which are provided with a pair of aligned perforations 9E. In the expansible linkage section 2A shown in FIG. 7A, the top and bottom links are of substantially the same lengths as shown and described in the above mentioned patents. As shown in FIG. 7B, when the inner member 9 is assembled with the outer member 4, the tabs 9D are adjacent to the side walls of the outer member and the perforations 9E register with the perforations 4D of the side walls of the outer member and consequently the outer member 4 of FIGS. 7, 7A and 7B is not as wide as the outer member of FIG. 3 of the drawings.

An expansible linkage of the first embodiment shown in FIGS. 1 through 14 is new, economical to manufacture and assemble, durable in use, thin and attractive in appearance and its length may be adjusted quickly and easily by the retail dealer without removing the outer member 4. It will be obvious to persons skilled in the art that this embodiment of the invention has satisfied the above described objects, advantages and long-felt need.

DETAILED DESCRIPTION OF THE SECOND EMBODIMENT

An expansible linkage section which can be used in the second embodiment is shown in FIGS. 15 through 18 of the drawings. This type of construction is shown and described in Augenstein U.S. Pat. No. 2,515,817 dated July 18, 1950, and it is commonly referred to as a scissors, lazy tongs or X-type expansible linkage.

It comprises a row of top links 60 and a row of bottom links 65. Each bottom link is provided with three hollow tubular elements 66, 67 and 68. The upper end of the central tubular element 67 passes through an opening 61 at the center of a first top link 60A and is peened over at 67A to pivotally secure the bottom link and the top link 60A together.

One end of the tubular element 68 extends through an opening 62 at one end of an adjacent top link 60B and is peened over at 68A to pivotally secure that end of the bottom link and the top link 60B together.

One end of the tubular element 66 extends through an opening near the end of the top link 60C and is peened over to pivotally secure that end of the bottom link to the top link 60C. In this way a series of superimposed top and bottom links are pivotally secured together in a scissors, lazy tongs or X arrangement as is well known in the prior art.

A plurality of coil springs 70 are provided, one for each of the central tubular elements 67. The coil part 70A of each spring is inserted in a central tubular element 67 of a top link. The downwardly extending end 70B of each coil spring is inserted in a tubular element 68 at one end of the same top link. The other end of the coil spring engages one side of the bottom shell 69, which is secured to the underlying bottom link.

Figure 15:
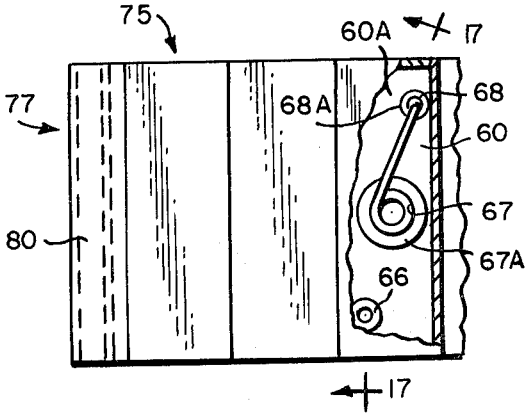
FIG. 15 is a top plan view of a second embodiment of a section of an expansible linkage which can be used for making expansible linkages embodying the invention with one of the top shells broken away to show a top link and one end of one of the coil springs used to return the linkage section from an expanded position to contracted position.
Figure 16:
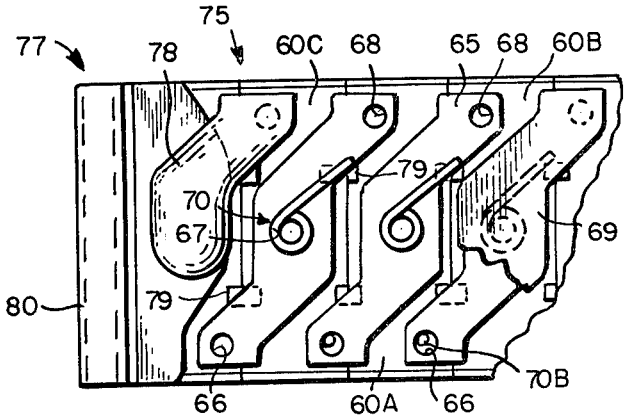
FIG. 16 is a bottom plan view of a portion of the section of linkage shown in FIG. 15 with the bottom shells omitted from two of the bottom links.

Thus, the springs 70 resist the displacement of the links upon exertion of a longitudinal stretching force and, upon the release of the stretching force, they return the links to their contracted positions shown in FIGS. 15 and 16.

Figure 17:
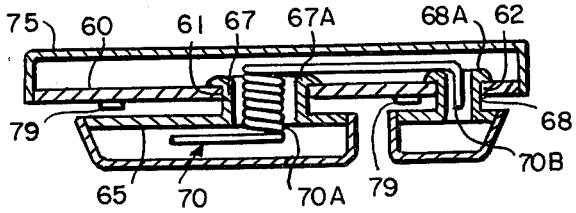
FIG. 17 is an enlarged section taken on the lines 17—17 of FIG. 15.
Figure 18:
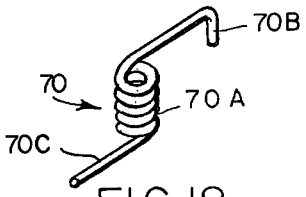
FIG. 18 is an isometric view of one of the coil springs used in the embodiment of FIGS. 15 to 17.

Each top link 60 is provided with a top shell 75 which is secured to the top links 60 by tabs 79 which are bent inwardly from the side walls of the central portions of the top shells and beneath the top link 60 (FIGS. 16 and 17). The central portions of the top shells are not provided with bottom walls — see FIGS. 16 and 17.

Figure 4:
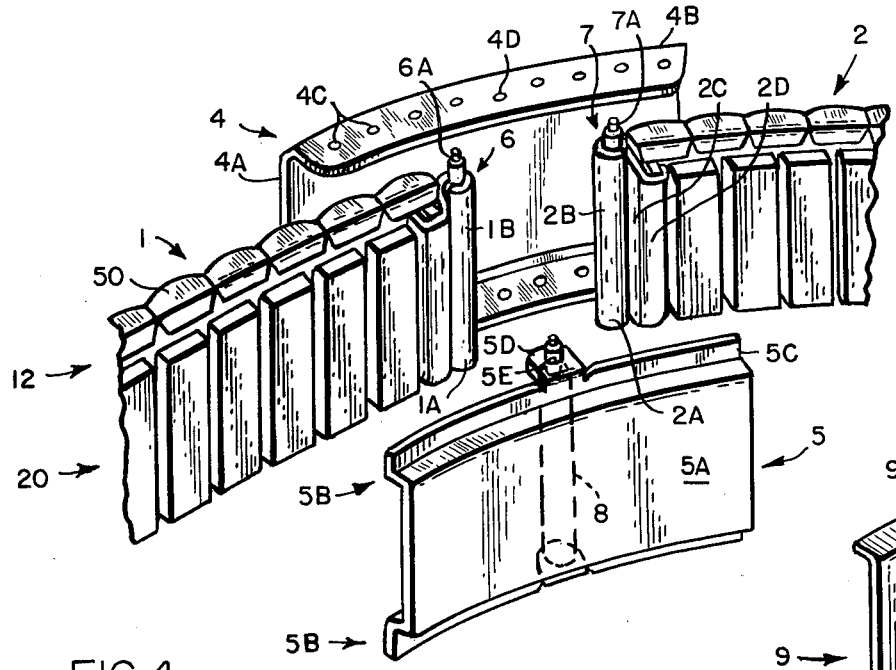
FIG. 4 is an exploded isometric view of the elements of the linkage of FIG. 1 shown in positions for assembly.

The end connector 77 is attached to one end of the linkage by a half bottom link 78 and it has a generally tubular end member 80 which is adapted to receive either the first or second spring pin means 6 or 7 (FIGS. 4 and 5).

Since the width of each expansible linkage section in contracted position is substantially equal to the lengths of the top shells and top links, two of these scissors or X-type expansible linkage sections can be assembled with the inner member and outer member shown in FIGS. 7, 7A and 7B by the insertion of first, second and third spring pin means 6, 7 and 8 in the generally tubular end members 80 and orifices 9E of the tabs 9D respectively and then inserting the outer ends of their trunions in selected pairs of aligned perforations 4C and 4D respectively.

Consequently the expansible linkage of this second embodiment satisfies the long-felt need and the objects of the invention as stated above for the first embodiment.

DETAILED DESCRIPTION OF THE THIRD EMBODIMENT

An expansible linkage section which can be used in the third embodiment is shown in FIGS. 19 through 22 of the drawings. This type of construction is shown and described in Augenstein U.S. Pat. No. 2,267,967 dated Dec. 30, 1941 and is commonly referred to as a Z-type or two-pivot type of expansible linkage.

It comprises a row of top links 82 and a row of bottom links 90. Each top link is provided with two hollow tubular elements 83 and 84.

The lower end of the tubular element 83 passes through an opening at one end of the bottom link 90A and is peened over at 83A to pivotally secure one end of the bottom link 90A to one end of the top link 82A.

The lower end of a tubular element 84 passes through an opening near the other end of the bottom link 90A and is peened over at 84A to pivotally secure the other end of the bottom link 90A to one end of the top link 82B.

In this way, a series of superimposed top and bottom links are pivotally secured together in a two-pivot or Z arrangement as is well known in the prior art.

A plurality of coil springs 95 are provided, one for each of the tubular pivots 83 and 84. Each spring comprises a coil part 95A and two outwardly extending fingers 95B and 95C. The finger 95C is provided with an extension 95D which extends at an angle of about 90° from the finger.

Figure 19:
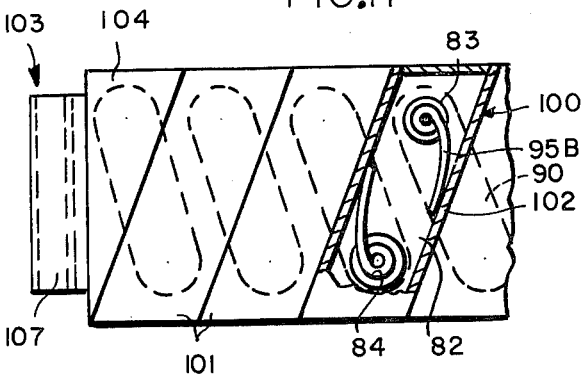
FIG. 19 is a top plan view of a third embodiment of a section of an expansible linkage which can be used for making expansible linkages embodying the invention with one of the top shells broken away to show the ends of two of the coil springs used to return the linkage section from an expanded position to contracted position.
Figure 20:
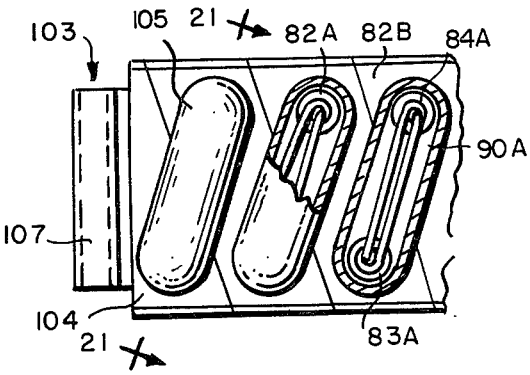
FIG. 20 is a bottom plan view of a portion of the section of linkage shown in FIG. 19 with portions of two of the bottom shells broken away to show the pivots and coil springs used to return the linkage section from an expanded position to contracted position.
Figure 21:
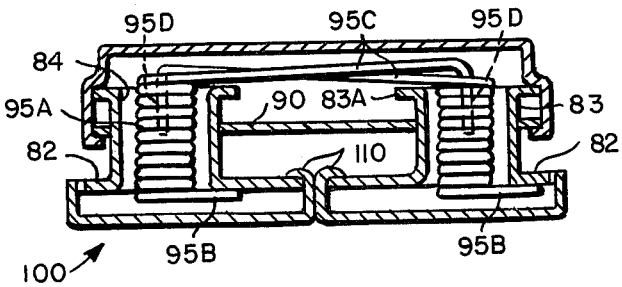
FIG. 21 is an enlarged section taken on the lines 21—21 of FIG. 20.
Figure 22:
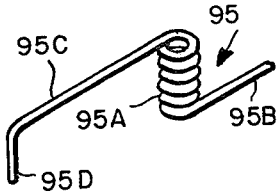
FIG. 22 is an isometric view of one of the coil springs used in this third embodiment.

The springs 95 are arranged in cooperating pairs with their coils extending through the hollow tubular pivot 83 and 84 and the extensions 95D extend into the coils 95A as shown in FIGS. 20 and 21 of the drawings. The ends of the fingers 95B engage the side walls 102 of a top shell 100 as shown in FIG. 19.

Thus, the springs cooperate to resist the displacement of the links upon the exertion of a longitudinal stretching force, and upon release of the stretching force, they return the links to their contracted positions shown in FIGS. 19 and 20.

Each top link 82 is provided with a top shell 100 which is secured to the top links 82 by tabs 110 which are bent inwardly from the central portions of the top shells and beneath the top links 82. The central portions of the top shells are not provided with bottom walls.

The end connector 103 is attached to one end of the linkage by a triangular shaped top link 104, one end of which is pivotally secured to one end of the end bottom link. The end connector 103 has a generally tubular end member 107 which is adapted to receive a first or second spring pin means 6 or 7 (FIGS. 4 and 5).

In assembling two of these Z or two-pivot expansible linkage sections to form a linkage embodying this invention, a channel shaped outer member and a one-piece inner member are provided which are of the correct widths to receive the ends of the sections and the outer ends of the first, second and third spring pin means are inserted in the appropriate perforations of side walls of the outer member.

Consequently, the expansible linkage of this third embodiment satisfies the long-felt need and the objects of the invention as stated above for the first and second embodiments.

While three desirable embodiments of expansible linkages embodying the invention have been shown in the drawings, and described in the specification, it is to be understood that this disclosure is for the purpose of illustration only, and that various changes in shape, proportion and arrangement of parts as well as the substitution of equivalent elements for those shown and described herein may be made without departing from the spirit and scope of the invention as set forth in the appended claims.

I claim:

1. In an expansible linkage including in combination, at least two sections of expansible linkages each of which comprises a row of top links and a row of bottom links, means interconnecting the links of each row with the links of the other row to provide displacement of the links relative to each other when the expansible linkage section is stretched longitudinally from a contracted to an expanded position, and resilient means associated with said links for resisting the displacement of said links and for returning them from expanded to contracted positions upon release of the longitudinal stretching force, the improvement comprising, a channel shaped outer member which comprises a top wall, a pair of spaced side walls and a series of aligned perforations extending thru said side walls, first spring pin means connected to one end of one of said expansible sections having the outer ends of its trunions extending into a first selected pair of said aligned perforations, second spring pin means connected to one end of the other of said expansible sections having the outer ends of its trunions extending into a second selected pair of said aligned perforations which are spaced longitudinally from said first pair, a one-piece inner member which comprises a bottom wall and a pair of spaced upwardly extending side members and means for detachably connecting said upwardly extending side members to said side walls of said channel shaped outer member substantially midway between the ends of said outer member, whereby said inner member closes the opening between the lower ends of the side walls of said channel shaped outer member, said ends of said expansible linkage sections are positioned between the top wall of said channel shaped outer member and the bottom wall of said inner member and the trunions of the first and second spring pin means can be depressed from the exterior of the channel shaped outer member to adjust the length of the linkage.

2. An expansible linkage according to claim 1 wherein the upwardly extending side members comprise a pair of tab means and a pair of aligned perforations extending through said tab means, and said expansible linkage also comprises third spring pin means having its trunions extending into said pair of aligned perforations of said tab means.

3. An expansible linkage according to claim 1 wherien said top links are longer than said bottom links, the side walls of said channel shaped outer member are spaced apart a greater distance than the length of said top links, and said upwardly extending side members of said inner member are spaced apart a shorter distance than the side walls of said channel shaped member and a greater distance than the length of said bottom links.

4. An expansible linkage according to claim 3 wherein said inner member also comprises flanges extending outwardly from the upper ends of said upwardly extending side members beneath the inner surfaces of the outer portions of said top links.

5. An expansible linkage according to claim 4 wherein said means for detachably connecting the spaced upwardly extending side members of said inner member comprise a pair of tabs which extend upwardly from said outwardly extending flanges.

6. An expansible linkage according to claim 1 wherein said means for detachably connecting said upwardly extending side members of said inner member to said side walls of said channel shaped outer member comprises third spring pin means which is located substantially at the centers of said upwardly extending side members having the outer ends of its trunions extending into a pair of perforations which is substantially at the center of said series of aligned perforations.

7. An expansible linkage according to claim 6 wherein the pair of aligned perforations which receive the outer ends of the trunions of said third spring means are located out of alignment with said series of aligned perforations for receiving the outer ends of the trunions of said first and second spring pin means.

8. An expansible linkage according to claim 1 wherein the upwardly extending side members of the inner member are positioned within the downwardly extending side walls of the outer member and thereby concealed from view.

9. An expansible linkage according to claim 1 wherein said top links are of substantially the same length as said bottom links, and the side walls of said channel shaped outer member and said upwardly extending side members of said inner member are spaced apart substantially the same distances.

10. An expansible linkage according to claim 9 wherein said inner member also comprises flanges extending inwardly from the upper ends of said upwardly extending side members and said means for detachably connecting the spaced upwardly extending side members of said inner member comprise a pair of tabs which extend upwardly from said inwardly extending flanges.

* * * * *

UNITED STATES PATENT AND TRADEMARK OFFICE

CERTIFICATE OF CORRECTION

PATENT NO. : 4,096,688

DATED : June 27, 1978

INVENTOR(S) : Kurt Albert Rieth

It is certified that error appears in the above-identified patent and that said Letters Patent are hereby corrected as shown below:

ABSTRACT

Column 2, line 6, delete the first "of".

Signed and Sealed this

*Twenty-first* Day of *November 1978*

[SEAL]

*Attest:*

RUTH C. MASON
*Attesting Officer*

DONALD W. BANNER
*Commissioner of Patents and Trademarks*